US006325235B1

(12) United States Patent
Telvin et al.

(10) Patent No.: US 6,325,235 B1
(45) Date of Patent: Dec. 4, 2001

(54) RECEPTACLE STRUCTURE AND A METHOD OF PACKAGING A PRODUCT AND MORE PARTICULARLY A BEVERAGE SUCH AS BEER BY MEANS OF THE RECEPTACLE

(75) Inventors: John Telvin, Harrogate (GB); Andrew Wallis, Bierne (FR)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/485,181

(22) PCT Filed: Jul. 31, 1998

(86) PCT No.: PCT/EP98/04787

§ 371 Date: Apr. 19, 2000

§ 102(e) Date: Apr. 19, 2000

(87) PCT Pub. No.: WO99/07606

PCT Pub. Date: Feb. 18, 1999

(30) Foreign Application Priority Data

Aug. 5, 1997 (FR) ..... 97 10237

(51) Int. Cl.[7] ..... B65D 83/00
(52) U.S. Cl. ..... 220/582; 215/228
(58) Field of Search ..... 220/582, 212, 220/694, 722; 215/228

(56) References Cited

U.S. PATENT DOCUMENTS 4,175,597 * 11/1979 Peterson ..... 215/228 X
4,934,543 * 6/1990 Schmidt ..... 215/228
5,329,975 * 7/1994 Heitel ..... 215/228 X
5,823,372 * 10/1998 Levine ..... 215/228
5,836,364 * 11/1998 Burton ..... 215/228 X
5,957,317 * 9/1999 Lee ..... 215/228 X

FOREIGN PATENT DOCUMENTS 27 14 917 10/1978 (DE) .
G 83 05 740.4 7/1983 (DE) .
3322811 3/1985 (DE) .
0 360 373 3/1990 (EP) .
1 331 425 9/1973 (GB) .
2 254 594 10/1992 (GB) .
2 273 693 6/1994 (GB) .
WO 93/15973 8/1993 (WO) .
WO 97/16966 8/1994 (WO) .
WO 97/00213 1/1997 (WO) .

* cited by examiner

*Primary Examiner*—Steven Pollard
(74) *Attorney, Agent, or Firm*—Harness, Dickey & Pierce, P.L.C.

(57) ABSTRACT

The receptacle (1) is in the form of a closed hollow body (2) including a side wall (2*a*) and two end walls, one of which (2*b*) called the "emptying" wall, is designed to be opened in order subsequently to empty the receptacle. The hollow body (2) includes, in its other end wall (2*c*), an orifice (3) for filling the hollow body; the receptacle also includes means for closing said orifice (3), e.g. in the form of a removable cap (7). The receptacle includes an add-on hollow part (8) for containing a gas under pressure and designed to be fixed through the filling wall (2*c*) of the hollow body (2), being inserted into the hollow body via the filling orifice (3) in said wall, and including one or more escape openings (8*b*) making it possible, once the hollow part has been fixed through the filling wall (2*c*) to put the inside of the hollow part (8) into communication with the inside of the hollow body (2).

15 Claims, 7 Drawing Sheets

RECEPTACLE STRUCTURE AND A METHOD OF PACKAGING A PRODUCT AND MORE PARTICULARLY A BEVERAGE SUCH AS BEER BY MEANS OF THE RECEPTACLE

The present invention relates to a closed receptacle that is used more particularly, but not exclusively, for packaging foodstuffs, and in particular liquid beverages, and in which there is provided a chamber for containing a gas under pressure, e.g. nitrogen, which gas is automatically released when the receptacle is opened and acts on the contents of the receptacle. The invention also relates to a novel method of packaging a product by means of the receptacle. The invention is particularly, but not exclusively, applicable to making a closed receptacle containing beer and advantageously capable of being in the form of a glass, e.g. obtained by injection blow-molding one or more thermoplastic resins, with the action of the gas on the beer when the glass is opened enabling a head to be formed that is firm and smooth. This novel packaging in the form of a glass advantageously gives consumers at home the chance to drink beer comparable to beer that has been served traditionally, from a hand-pulled pump, for example in premises specialized in selling drinks.

It is now common practice to sell foodstuffs, and in particular beverages, such as beer, that are packaged in closed metal cans made mainly of aluminum. In conventional manner, such a can is in the form of a closed hollow body made up of two distinct portions: a main portion which is generally cylindrical and closed at its bottom end by a bottom wall, and having a top face that is open; together with a cover or closure member designed to be fitted to and fixed on the main portion so as to close it. The main portion and the cover or closure member are manufactured separately. During manufacture, manual opening means are provided on the cover or closure member, which means are generally in the form of a tab enabling the consumer to open the can by hand so as to be able to empty out its contents, with this being done by pushing or pulling the outside face of the cover or closure member on the can so as to rupture it by piercing it and/or by tearing it.

To package a product using that known type of receptacle, the first step consists in filling the main portion of the receptacle with the product, prior to putting the cover or closure member into place. Once the main portion has been filled, the cover or closure member is fixed to the main portion by any appropriate means, and the full receptacle is suitable for being put on sale. The step of fixing the cover or closure member on the main portion is relatively difficult to perform because of the sealing constraints that must be satisfied between the cover and the main portion of the receptacle, which constraints are made all the more difficult to satisfy when sealing needs to be achieved over a relatively long length, e.g. the entire periphery of the main portion of the receptacle.

It is also known at present to make receptacles containing a chamber filled with gas under pressure, which gas is released when the receptacle is opened and acts on the product contained in the receptacle. This type of receptacle is used in particular in the field of packaging beer in cans. In this particular field, and for the purpose of putting beer on sale which, once served in a glass, is comparable to a hand-pulled draught beer, numerous brewers fit their cans of beer with internal chambers that are in communication with the inside of the can and that contain a gas under pressure, e.g. nitrogen. In practice, the chamber is in the form of a small hollow add-on part [sometimes called a "widget"] which can have a wide variety of shapes, which is usually made of plastic, and which is fixed by any appropriate means to the inside face of the bottom wall of the can. The add-on part also has one or more escape openings formed therein, enabling the inside of the hollow part to communicate with the inside of the can. When the consumer opens a beer can fitted with an internal chamber containing gas under pressure, the act of putting the inside of the can to atmospheric pressure allows the gas contained in the chamber to be released, thereby putting a head on the beer.

At present, beer is packaged in a can having a chamber containing a gas under pressure as follows. The add-on part that is to form the chamber containing the gas under pressure is fixed to the inside of the main portion of the can, by being inserted through its open top face. This part is fixed by any appropriate known means, and in particular by adhesive or by heat-sealing. This step is relatively difficult, and it also requires special tooling to be used that is capable of passing through the opening in the top face of the main portion of the can so as to enable the chamber to be positioned and fixed in the bottom of the can. Thereafter the main portion of the can is filled with beer, and a predetermined quantity of gas under pressure is inserted, where the quantity is a function of the capacity of the can. In general, the gas used is nitrogen. Once the quantity of gas has been inserted, the top portion of the can is closed by mechanically fixing the cover on its open top. All of the above steps are performed with the bottom of the can generally pointing downwards. Once the main portion and the cover of the can have been assembled together in sealed manner, a last step consists in turning the can upside-down so as to cause its bottom to be on top, thereby having the effect of filling the chamber with the gas under pressure, with molecules of gas rising towards the chamber and entering therein. After a given length of time has elapsed, the chamber is full of gas under pressure and the can be handled freely, in particular for the purpose of being transported to its point of sale.

In prior art EP.O.360.373A, it is disclosed a can constituted by a tubular body closed at both sides by two separate closure walls that are sealed thereto: one closure wall (top wall) is openable via a pull ring. An add-on hollow part (widget) constituted by an inner partition wall with a small communication orifice is mounted inside the tubular body. This inner partition wall is locked to the rim of the tubular element by the closure of the bottom closure wall, or may be sealed to the tubular body prior to the closure of the bottom closure wall. The use of a can having a tubular body and a separate bottom closure is advantageous since it enables to introduce the beverage and the gas in the can via the bottom opening of the tubular wall, prior to the fitting of the partition wall to the rim of the tubular body. But this solution complicates the assembling operation of the can and in particular the step of fixing the bottom closing wall to the tubular body is relatively difficult to perform because of the sealing constraints that must be satisfied over the entire periphery of the tubular body. This step is further more difficult to perform when the bottom closure wall is used for locking the inner partition wall to the rim of the tubular body.

The main object of the invention is to propose a receptacle that makes it possible to simplify the process of packaging a product in a receptacle of the type including an internal chamber for the purpose of containing a gas under pressure that is suitable for being released when the receptacle is opened.

This object is achieved by the receptacle of the invention having the features of claim 1.

The invention also provides a method of packaging a product by means of a receptacle according to claim 1. In the method, the product is inserted into the inside of the hollow body by causing it to pass through the filling orifice, a quantity of gas is inserted through the same orifice, the hollow part is put into place through said orifice, and the hollow body is closed by closing the filling orifice.

Compared with can structures that have been used in the past for packaging a beverage, and in particular a beer, the novel structure of the receptacle in accordance with claim 1 makes it possible to simplify the operations of installing and fixing the add-on chamber-forming part relative to the hollow body. It also makes it possible to perform packaging from a first step of filling the receptacle while keeping the receptacle in the same position, i.e. with its filling wall on top, thereby avoiding an operation of turning the receptacle upside-down in order to fill the hollow part with the gas under pressure. In the structure of the invention, the filling orifice must be dimensioned so as to allow the hollow part to pass therethrough, but in practice the hollow part is compact. Consequently, the filling orifice is advantageously of a diameter that is small compared with the diameter of the hollow body of the receptacle, thereby making it easier to comply with sealing constraints at the filling orifice.

Other characteristics and advantages of the invention appear more clearly on reading the following description of two preferred embodiments of a glass-shaped receptacle of the invention, which description is given by way of non-limiting example and with reference to the accompanying drawings, in which.

Figure 1:
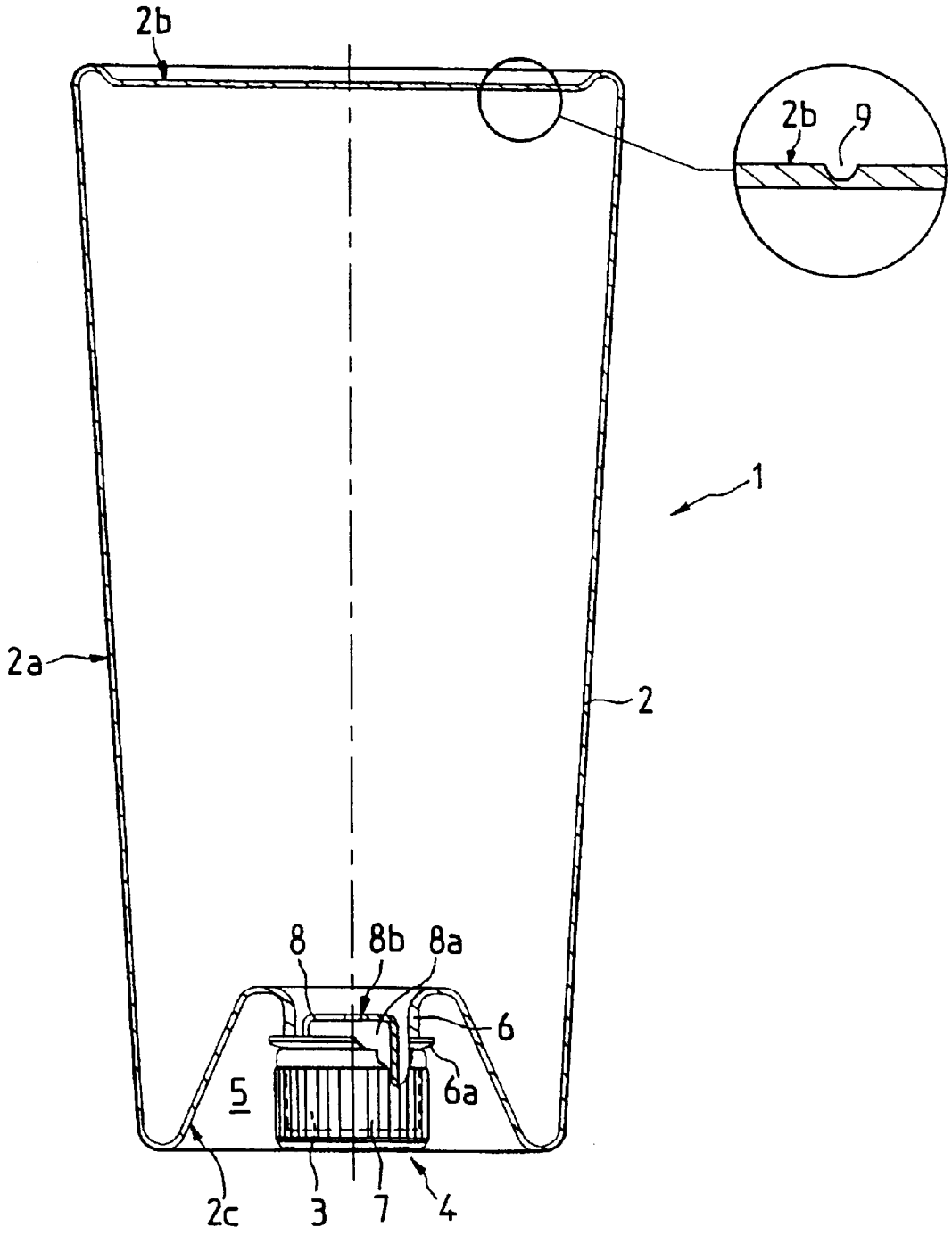
FIG. 1 is a section view through a first embodiment of a glass-shaped receptacle of the invention whose bottom forms a punt serving as a housing for the filling neck of the receptacle.

FIG. 1 shows a first embodiment of a receptacle of the invention, which is more particularly intended to contain a beverage, for example beer. The receptacle 1 comprises a hollow body 2 constituted by a one-piece molding, comprising a side wall 2*a,* and two end walls 2*b* and 2*c*. The end wall 2*b* corresponds to the emptying wall of the body 2 and it is designed to be ruptured manually in a manner described in greater detail below with reference to FIGS. 4 to 7. The end wall 2*c* corresponds to the filling wall of the hollow body 2 and it includes an orifice 3 through which the hollow body is filled, and suitable for being closed by closure means 4.

In the particular embodiment shown in FIG. 1, the hollow body is more particularly in the form of a glass of section that flares from its filling wall 2*c* to its emptying wall 2*b*. The filling wall 2*c* is in the form of a reentrant kick or "punt" projecting into the hollow body and defining a cavity 5, with a neck 6 being formed at the filling orifice 3 and being fully received inside the cavity 5. The closure means 4 are in the form of a cap 7 suitable for being removably fitted to the neck 6. In the particular example shown in the figures, the neck 6 is threaded and the cap 7 has an inside thread enabling the cap 7 to be screwed onto the neck 6 until the cap 7 bears against a collar 6*a* on the neck 6, thereby ensuring sealed closure. The cap 7 can thus easily be installed on the neck 6 in order to close the receptacle 1, or it can be removed from the neck 6, merely by being screwed or unscrewed. Nevertheless, in the context of the invention, the cap 7 may be replaced by any other closure means enabling the filling orifice 3 to be closed once the receptacle 1 has been filled. The closure means is not necessarily removable from the hollow body, and it could be designed to close the filling orifice 3 definitively once the hollow body 2 has been filled.

More particularly, in the example of FIG. 1, the receptacle also includes a hollow part 8 which is designed to be fixed through the filling wall 2*c,* and more particularly to be mounted inside the neck 6. This hollow part 8 defines an internal chamber 8*a* which is designed to be filled with gas under pressure. The wall of the hollow part 8 also includes at least one escape opening 8*a* enabling the internal chamber 8*b* to be put into communication with the inside of the hollow body 2 once the hollow part 8 has been put into place in the neck 6.

Figure 8:
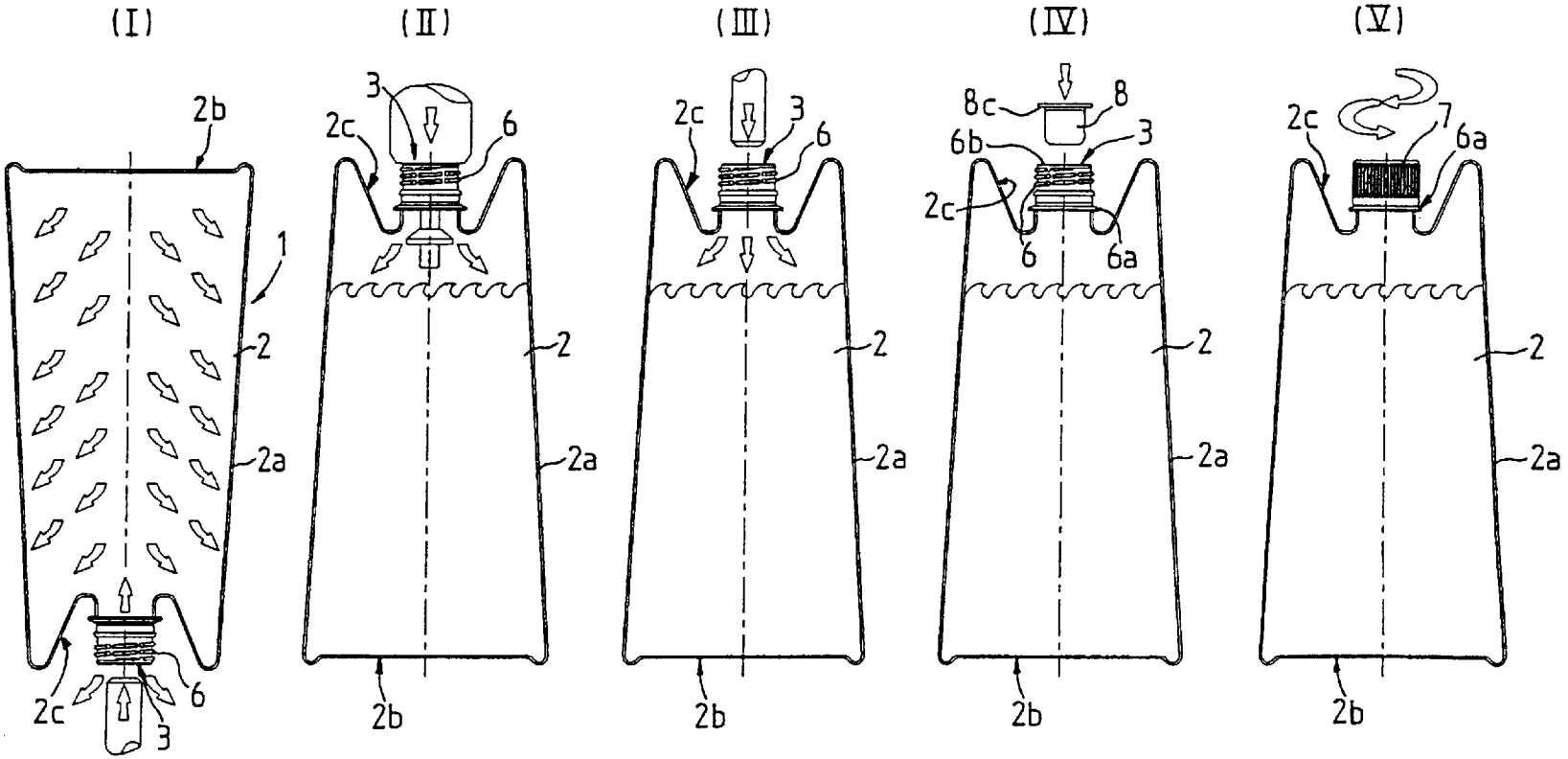
FIG. 8 shows the main steps implemented for packaging a liquid in the receptacle of FIG. 1.

In the particular example shown, the hollow part 8 advantageously includes a flange 8*c* (FIG. 8) of diameter greater than the diameter of the filling orifice 3, such that once the hollow part has been inserted in the neck 6 through the filling orifice 3, the flange 8*c* comes into abutment against the filling wall 2*c* at the end 6*b* of the neck 6 (FIG. 8). Once the cap 7 has been screwed onto the neck 6, the flange 8*c* is locked in position between the end of the neck 6 and the end wall of the cap 7.

With reference to FIG. 1, once the hollow part 8 has been put into the neck 6 and the cap 7 screwed onto the neck 6, the cap 7 no longer projects from the hollow body 2 but is completely received inside the punt-forming cavity 7. As a result, the filler wall 2*c* forms a stable base for the receptacle of FIG. 1 which can thus advantageously be stood in stable manner on a plane surface in the position shown in FIG. 1.

Figure 4:
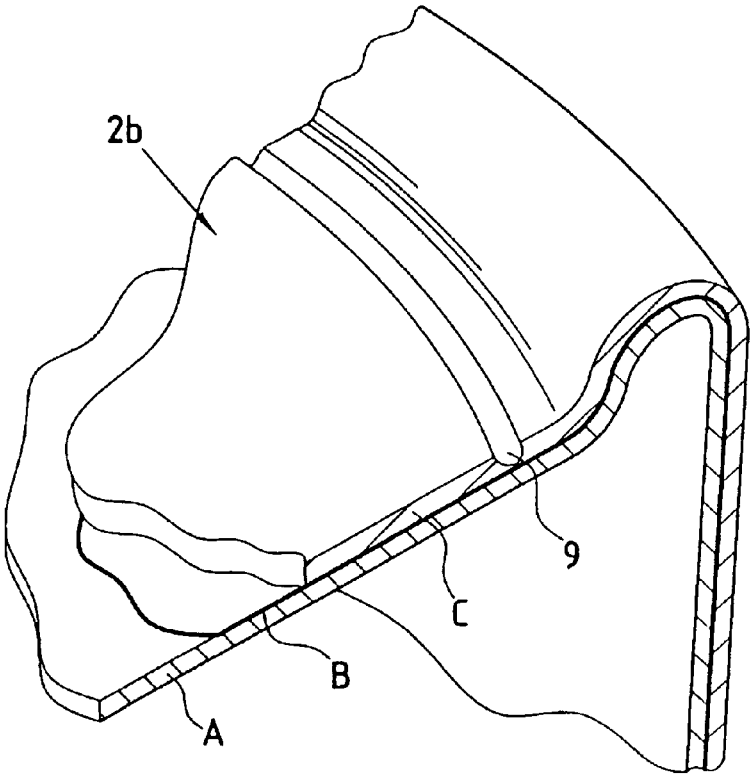
FIG. 4 is a fragmentary perspective view of the emptying wall of the FIG. 1 receptacle in which a circular groove is provided defining a zone of weakness enabling the emptying wall to be ruptured manually.
Figure 5:
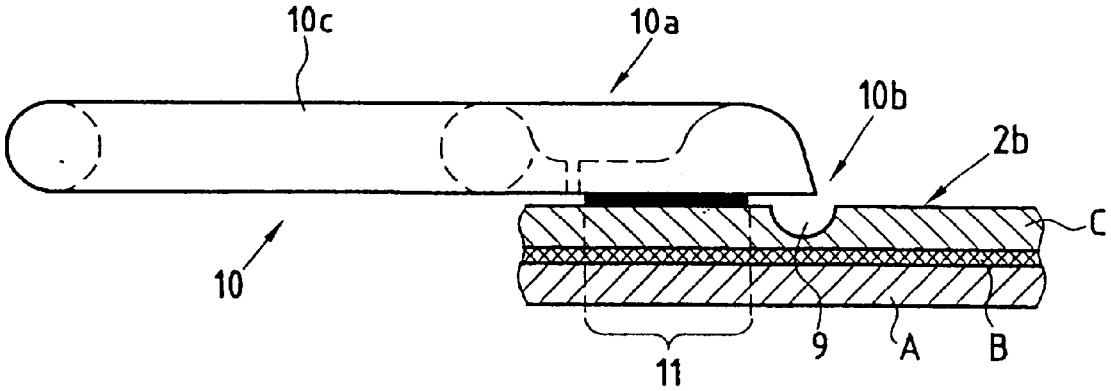
FIG. 5 is a diagram showing an opening tab fixed onto the emptying wall of the FIG. 1 receptacle and enabling said emptying wall to be ruptured by hand.
Figure 6:
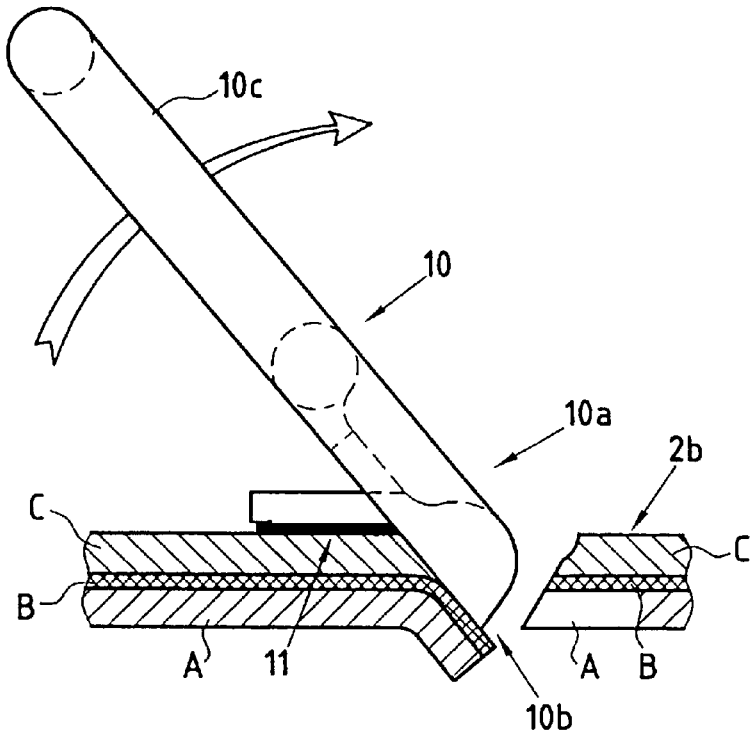
FIGS. 6 and 7 show two main stages in the use of the tab of FIG. 5 to open the receptacle of FIG. 1.
Figure 7:
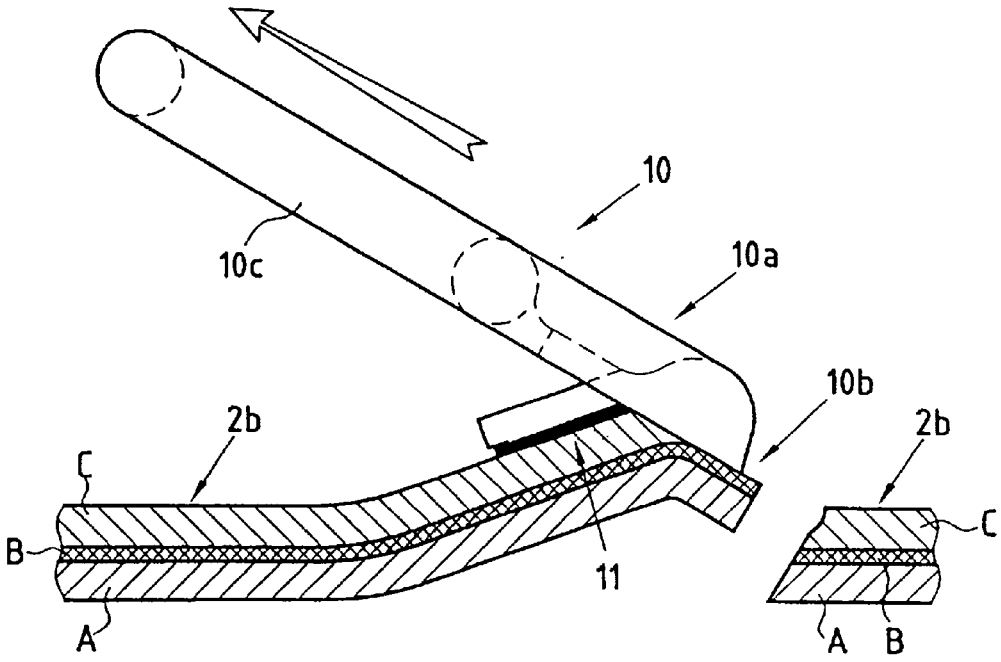

With reference to FIG. 4, the emptying wall 2*b* of the FIG. 1 receptacle includes a groove 9 in its outside face defining a zone of weakness which, in a preferred embodiment, forms a ring of large diameter that is slightly smaller than the maximum diameter of the emptying wall 2*b*. With reference to FIG. 5, in order to make it easier for a user to rupture the emptying wall 9 manually, the receptacle 1 has an opening tab 10 fitted thereon and fixed to the outside face of the emptying wall 2*b*. More particularly, the opening tab 10 is fixed on the outside face of the emptying wall 2*b* at one of its ends 10*a* in a limited fixing zone 11 adjacent to the groove 9. The tab 10 is fixed to the emptying wall 2*b* in any appropriate manner known to the person skilled in the art, and if they are both made of plastics materials, it can be fixed by heat sealing. At its end 10*a,* the opening tab 10 includes a sharp edge 10*b* overlying the groove 9.

The tab 10 is used to open the receptacle 1 by rupturing the emptying wall 2*b* as follows. In a first step shown in FIG. 6, the opening tab 10 is raised by taking hold of its free end 10*c* remote from the fixing zone 11, which end is not secured to the emptying wall 2*b*. This enables the opening tab 10 to be pivoted relative to the emptying wall 2, and the bond between the opening tab 10 and the wall 2*b* in the fixing zone 11 is partially ruptured. This rotation enables the sharp edge 10*b* to come into contact with the groove 9 and thus exert mechanical pressure on the groove 9, giving rise to the emptying wall 2*b* being locally pierced by the opening tab 10. In a second step shown in FIG. 7, the emptying wall 2*b* is pulled away by pulling on the tab 10, thereby enabling the emptying wall 2*b* to be completely torn off at the annular groove 9. After the FIG. 1 receptacle has been opened, all that remains of the emptying wall 2*b* is its peripheral portion that initially extended between the groove 9 and the side wall 2*a,* with the central portion of the emptying wall 2*b* as defined by the groove 9 being completely removed. After opening, the consumer is left holding the equivalent of a glass, and can thus drink the contents of the receptacle 1 directly therefrom.

The invention is not restricted to a receptacle whose emptying face includes a rupture zone that is circular in shape enabling the major portion of the emptying wall 2*b* to be removed from the hollow body 2. It could, for example, be constituted by a thinner zone, and more generally a zone of reduced strength of limited area, for example it could be in the form of a disk of very small diameter enabling the emptying face 2*b* to be pierced locally, in particular by means of a straw, or more generally by means of a device acting as a punch and possibly being secured to the hollow body of the receptacle. The zone of reduced mechanical strenght could also be made by using in this zone a distinct material of lower strenght.

The hollow body of a receptacle of the invention is preferably, but not exclusively made of any material that is capable of being molded. Preferably, for the variant shown in FIG. 1, the hollow body 2 is made by injection and blow-molding at least one thermoplastic resin. Nevertheless, the invention is not limited to the injection blow-molding technique. It is also possible to envisage making the hollow body of the receptacle by extrusion and blow-molding or indeed by thermoforming.

Figure 2:
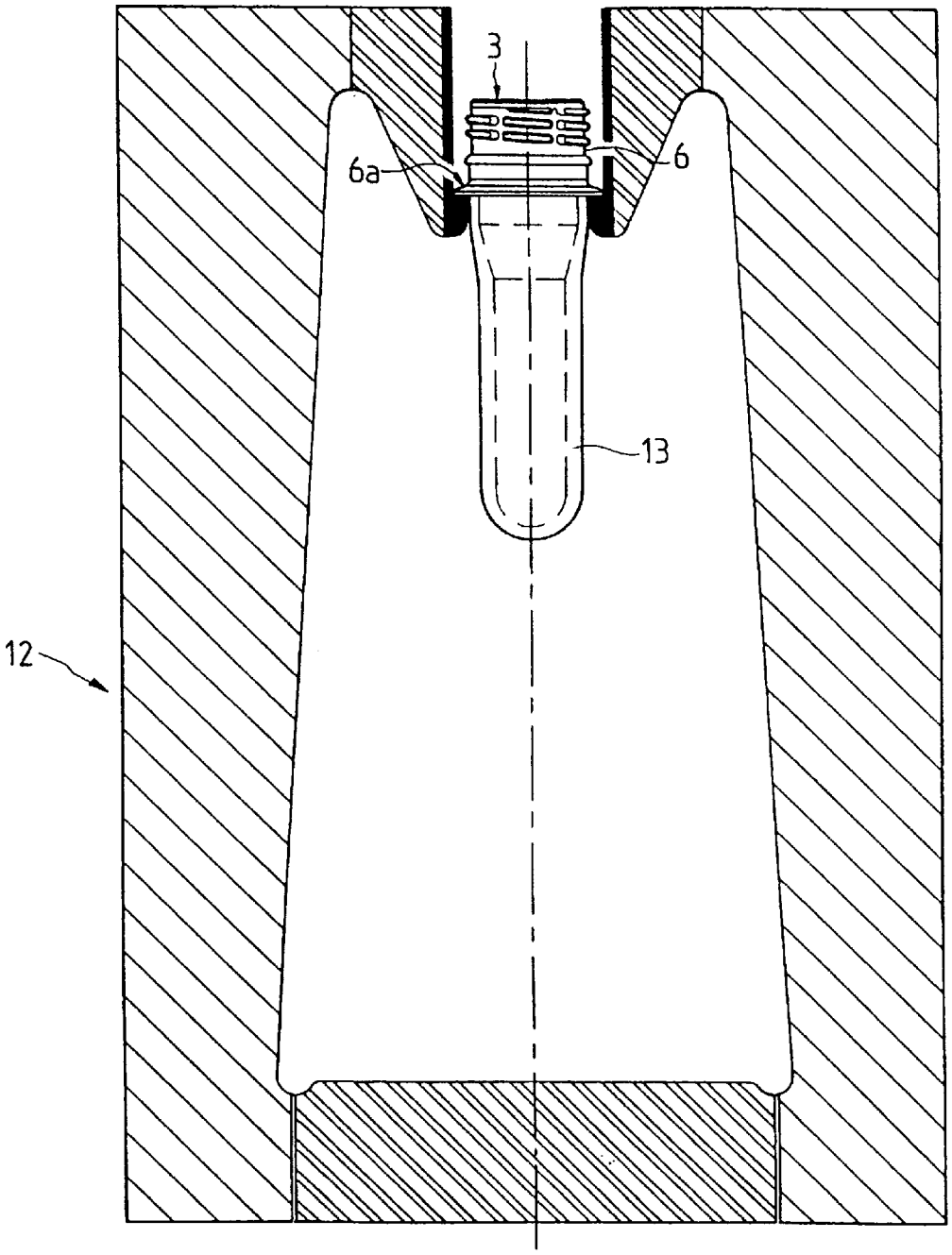
FIGS. 2 and 3 are section views through a mold showing the steps of blowing a parison to obtain the receptacle of FIG. 1.
Figure 3:
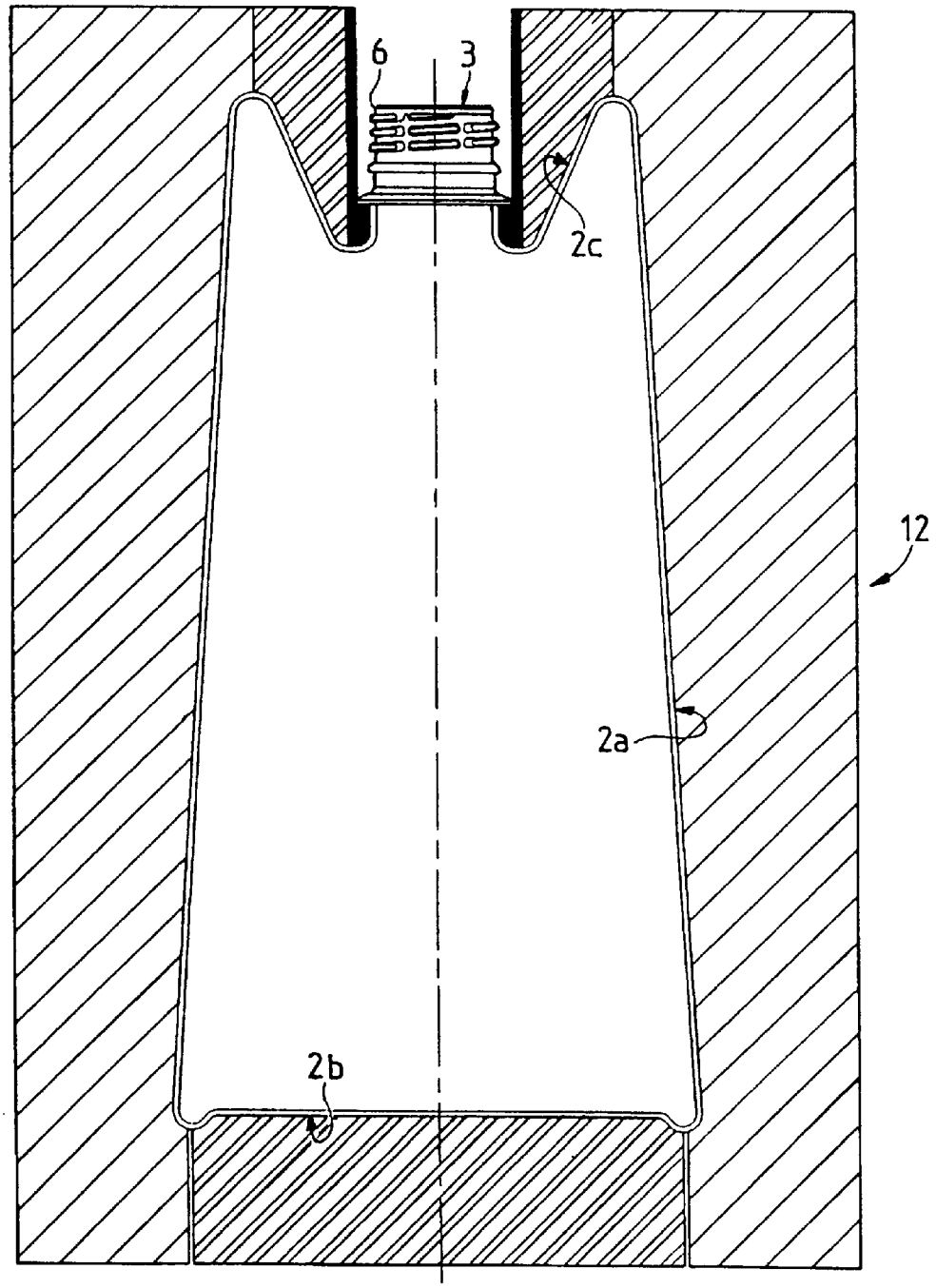

FIGS. 2 and 3 show an example of a mold 12 used for making the hollow body 2 of the FIG. 1 receptacle by blowing and stretching a preform or "parison" 13 (FIG. 2) made by injecting one or more thermoplastic resins. In conventional manner, the hollow body 2 of the FIG. 1 receptacle 1 can be made by injection blow-molding in a single step or in two steps. For a single step, the parison 13 is blown into the mold 12 immediately after being injected and without having time to cool. In a two-stage method, the parison is not blown immediately after injection, but is preheated prior to blowing.

The choice of thermoplastic resin depends to a large extent on the product that is to be stored in the receptacle 1 and on the properties the receptacle 1 is to have relative to the product. These properties may be anti-UV, impermeability to gas, etc . . . . When the receptacle 1 is to contain a carbonated beverage, then impermeability to carbon dioxide and oxygen are particularly required. Under such circumstances, a thermoplastic resin is used that enables an effective barrier to be formed against carbon dioxide molecules contained in the carbonated beverage passing out through the walls of the receptacle, and conversely also enabling an effective barrier to be formed against oxygen molecules penetrating into the receptacle, the purpose being to maximize lifetime of the carbonated beverage inside the receptacle. In this context, and by way of example, the hollow body of the receptacle 1 may be made of polyethylene 2,6-naphthalane dicarboxylate (PEN) resin. The receptacle 1 may also advantageously be made from a multilayer parison 14 made in conventional manner by sequential or parallel injection of at least two different thermoplastic resins, one of which has barrier properties relative to carbon dioxide and to oxygen. By way of example, it may be a polyamide resin containing m-xylene groups, commonly referred to as "Mx-nylon", or indeed a resin comprising a copolymer of ethylene and vinyl alcohol, for example an EVOH resin. With reference, for example, to FIG. 4, the receptacle 1 is made from a three-layer parison: an inner layer A and an outer layer C are made of any thermoplastic resin, and preferably a very cheap resin, for example polyethylene terephthtalate (PET), while the middle layer B performs the barrier function and is made, for example, of Mx-nylon or of EVOH resin.

On being taken out of the mold 12 of FIGS. 2 and 3, the hollow body 2 has a smooth emptying wall 2*b* . The groove 9 is then formed in an additional step by using any appropriate means to remove material from the outside face of the emptying wall 2*b* . Preferably, material is removed by laser. In the particular example of FIG. 4, the groove 9 is more particularly obtained by using a laser to cut through the outer layer C.

Once the groove 9 has been formed in the outside face of the emptying wall 2*b*, any appropriate means can be used to secure the tab 10, and in particular heat sealing can be used when the tab 10 is made of a plastics material having substantially the same melting temperature as the thermoplastic material of the outer layer C.

The main steps involved in packaging a liquid in the receptacle of FIG. 1 are described below with reference to FIG. 8. In a first step I, the inside of the hollow body 2 of the receptacle is washed by injecting a washing liquid into said hollow body 2 through the filling orifice 3, the neck 6 preferably pointing downwards in order to facilitate removal of the washing liquid. In a second step II, the inside of the hollow body is filled with the liquid to be packaged. This second step and the following steps are advantageously performed with the hollow body 2 being kept in the same position, i.e. with its filling wall 2*c* on top. In a third step III, a quantity of gas is injected into the hollow body 2, e.g. a quantity of nitrogen. Then in a fourth step IV, the hollow part 8 is put into the neck 6 by inserting said hollow part 8 through the filling orifice 3 until its flange 8*c* comes into abutment against the end 6*b* of the neck 6. Then, in a final step V, the filling orifice 3 is closed by screwing the cap 7 onto the neck 6 until the cap 7 comes into contact with the collar 6*a* on the neck 6 and provides sealed closure for the hollow body 2. Once the cap 7 has been closed, and after a given length of time has elapsed, the gas previously injected into the hollow body 2 penetrates into the internal chamber 8*a* of the hollow part 8 via its escape openings 8*b*. The receptacle 1 can then be handled, and in particular it can be turned the right way up for storage and display for sale in the position shown in FIG. 1, i.e. with the filling wall 2*c* at the bottom.

To drink the liquid stored inside the receptacle 1, the user merely needs to open the receptacle by means of the opening tab 10 as described above. When the inside of the receptacle is put to atmospheric pressure, the gas initially contained inside the internal chamber 8*a* of the hollow part 8 is released into the receptacle, with the molecules of gas passing through the escape openings 8*b*.

The above-described packaging is particularly suitable for displaying beer for sale. After opening the receptacle 1, the consumer has a glass enabling the beer to be drunk directly without any need to pour the beer into a glass. Furthermore, the automatic release of gas inside the beer on the receptacle being opened advantageously enables the beer to form a head and take on an appearance and taste comparable to those of a beer from a hand-pulled pump.

Nevertheless, the invention is not limited to packaging a beverage or more particularly a beer, the FIG. 1 receptacle can be used for packaging any type of product capable of being inserted into a hollow body via the filling orifice 3.

Figure 9:
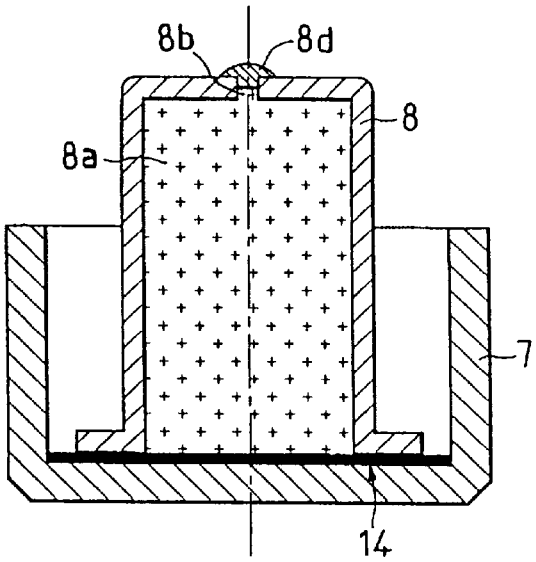
FIG. 9 shows a variant embodiment of the closure cap of the FIG. 1 receptacle in which the cap includes a hollow part filled with gas under pressure.

FIG. 9 shows a variant embodiment in which the hollow part 8 is an integral portion of the cap 7, being fixed to the end wall of the cap 7 with a peripheral gasket 14. More particularly, in the variant shown and according to an additional characteristic of the invention, the internal chamber 8*a* is filled with a gas under pressure, e.g. nitrogen, and the escape opening 8*b* is closed by a plug 8*c* made of a material that is suitable for dissolving on coming into contact with the liquid that is to be stored in the receptacle. With this particular embodiment, steps III and IV are omitted from the packaging method shown in FIG. 8. After step II in which the receptacle 1 is filled with liquid, it suffices to install the cap 7 on the neck 6 of the hollow body 2, with the hollow part 8 containing gas under pressure thus being put into place via the filling orifice 3, and with the hollow body then being closed by screwing the cap 7 onto the neck 6. On coming into contact with the liquid contained in the receptacle 1, the plug 8*c* closing the escape orifice 8*b* dissolves, thereby enabling the gas contained in the hollow part 8 to escape into the liquid contained in the receptacle. In another variant, the plug 8*c* could be made by a plug designed to be automatically pullet out when opening the emptying wall 2*b*. It could be for example a plug mechanicaly joined to the opening tab 10.

Figure 10:
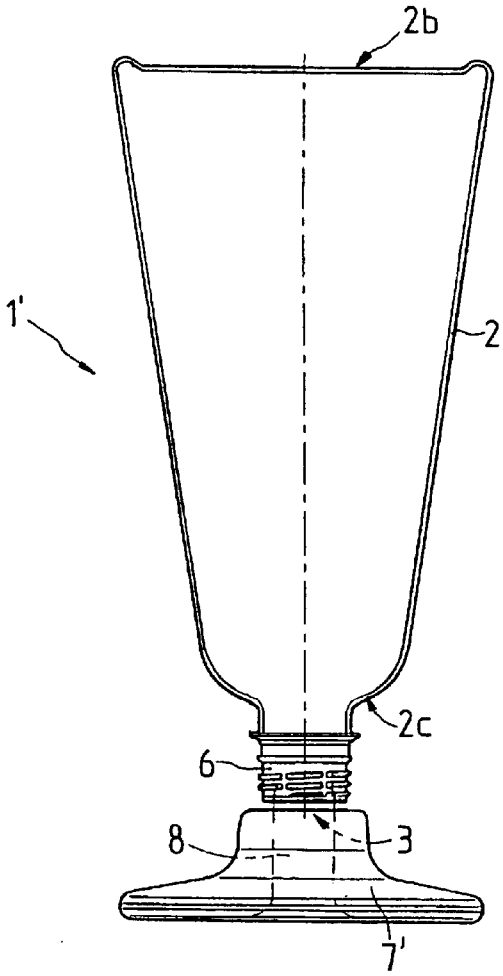
FIG. 10 shows another variant embodiment of a glass of the invention in which the closure cap forms a stable foot for the glass.

FIG. 10 shows another variant embodiment of a receptacle 1' of the invention, which differs essentially from the embodiment of FIG. 1 in that the cap 7' for closing the filling orifice 3 is designed to form a stable base for a hollow body 2 once the cap 7' has been put into place on the neck 6 to close the filling orifice 3. In the particular example shown, once the cap 7' and the hollow body have been assembled together, the receptacle 1' forms a glass having a foot.

What is claimed is:

1. A receptacle comprising:

a closed hollow body (2) including a side wall (2*a*), and two end walls, one of which (2*b*), called the "emptying" wall, is designed to be opened in order subsequently to empty the receptacle, an add-on hollow part, defining a chamber in communication with the inside of the hollow body, and designed to contain a gas under pressure, the receptacle being characterized in that the hollow body (2) includes in its other end wall (2*c*), call the "filling" wall, an orifice (3) for filling the hollow body, in that at least the side wall (2*a*) and the filling wall (2*c*) of the hollow body (2) are made in a single piece, in that the receptacle includes a closure engaged therewith and closing said orifice, the add-on hollow part (8) is fixed through the filling wall (2*c*) by being inserted into the hollow body (2) via the filling orifice in said wall.

2. A receptacle according to claim 1, characterized in that the closure is constituted by a cap (7') forming a stable base for the hollow body (2).

3. A receptacle according to claim 1, characterized in that the hollow body is made in a single piece by molding, and preferably by injection and blow-molding one or more thermoplastic resins.

4. A receptacle according to claim 1, characterized in that the hollow body (2) is in the form of a glass that preferably flares upwards from the filling wall (2*c*) to the emptying wall (2*b*).

5. A receptacle according to claim 1, characterized in that the hollow part (8) includes a flange (8*c*) whose diameter is greater than the diameter of the orifice (3), and which comes into abutment against the filling wall (2*c*) when said part is mounted through the orifice (3), and in that once the closure has been put into place it locks the flange (8*c*) of the hollow part (8) in position relative to the filling wall (2*c*).

6. A receptacle according to claim 5, wherein the hollow part is an integral part of the closure.

7. A receptacle according to claim 1, wherein said hollow body is of a material designed to contain a liquid product.

8. A receptacle according to claim 1, wherein the hollow part (8) includes portions defining escape openings (8*b*) that are closed by a material designed to be pulled out of engagement therewith when opening the receptacle.

9. A receptacle according to claim 1, in which the hollow body (2) contains beer and the hollow part (8) is a chamber filled with a gas under pressure.

10. A receptacle according to claim 1, characterized in that the hollow part (8) is an integral part of the closure.

11. A receptacle according to claim 1, wherein the hollow part contains a gas under pressure.

12. A receptacle according to claim 1, wherein the hollow part includes portions defining escape openings therein.

13. A receptacle according to claim 12, wherein said escape openings are closed by closure means engaged with the portions defining the escape openings.

14. A receptacle according to claim 13, wherein the closure means is a material dissolvable when in contact with a liquid contained in the receptacle.

15. A receptacle according to claim 1, wherein the closure is a means for closing the orifice.

* * * * *

UNITED STATES PATENT AND TRADEMARK OFFICE

CERTIFICATE OF CORRECTION

PATENT NO. : 6,325,235 B1
DATED : December 4, 2001
INVENTOR(S) : John Tevlin and Andrew Wallis It is certified that error appears in the above-identified patent and that said Letters Patent is hereby corrected as shown below:

Title page,
Item [75], Inventors, "John Telvin" should be -- John Tevlin --.

Signed and Sealed this

Twenty-second Day of October, 2002

*Attest:*

*Attesting Officer*

JAMES E. ROGAN
*Director of the United States Patent and Trademark Office*